US008342638B2

(12) United States Patent
Sole Pons et al.

(10) Patent No.: US 8,342,638 B2
(45) Date of Patent: Jan. 1, 2013

(54) SERVICING ARTICLE

(75) Inventors: Macia Sole Pons, Barcelona (ES); Xavier Gasso Puchal, Barcelona (ES); Marta Coma Vives, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 401 days.

(21) Appl. No.: 12/627,720

(22) Filed: Nov. 30, 2009

(65) Prior Publication Data

US 2011/0128321 A1 Jun. 2, 2011

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS

| | | | | |
|---|---|---|---|---|
| 473,696 | A | 4/1892 | Cowen | |
| 1,479,032 | A | 1/1924 | Egerton | |
| 2,675,906 | A | 4/1954 | Wagner | |
| 4,601,938 | A * | 7/1986 | Deacon et al. | 428/153 |
| 4,928,120 | A | 5/1990 | Spehrley, Jr. et al. | |
| 5,051,761 | A | 9/1991 | Fisher et al. | |
| 6,102,518 | A | 8/2000 | Taylor | |
| 6,135,585 | A | 10/2000 | Johnson et al. | |
| 7,036,905 | B2 | 5/2006 | Nagai et al. | |
| 7,165,826 | B2 | 1/2007 | Sugaya et al. | |
| 7,311,378 | B2 | 12/2007 | Fujimori et al. | |
| 7,972,551 | B2 * | 7/2011 | Ochi et al. | 264/331.11 |
| 2004/0155921 | A1 | 8/2004 | Simmons et al. | |
| 2005/0219310 | A1 | 10/2005 | Nakamura et al. | |
| 2007/0074802 | A1 * | 4/2007 | Glaug | 156/62.2 |
| 2008/0252685 | A1 | 10/2008 | Gomez et al. | |
| 2008/0266342 | A1 * | 10/2008 | Steinfield et al. | 347/14 |
| 2009/0073222 | A1 | 3/2009 | Hori | |

* cited by examiner

*Primary Examiner* — Matthew Luu
*Assistant Examiner* — Justin Seo
(74) *Attorney, Agent, or Firm* — Garry A. Perry

(57) ABSTRACT

In one embodiment, a servicing article comprises a web comprising a first material impregnated with a servicing fluid, the servicing fluid including a solvent that does not evaporate at ambient printer conditions, and a plurality of physical barriers within the first material, extending approximately across the first material's width, to restrict servicing fluid migration lengthwise along the web.

16 Claims, 5 Drawing Sheets

SERVICING ARTICLE

BACKGROUND

Printing systems, such as inkjet printers, may include one or more printheads. Each printhead includes a printing surface having a series of nozzles that are used to spray drops of ink. During operation of the printing systems, the printing surface may accumulate contaminants such as dried ink or drying ink. Such contaminants can clog nozzles so as to severely affect the performance of the printing system and print quality.

One method of addressing the issue of accumulating contaminants is to periodically service the printhead to remove the contaminants/residue. Some printing systems sometimes include a service station that, among other things, periodically cleans the printing surface of the printhead by wiping the printing surface. The service station may include a web of wiping material (hereinafter referred to as a "web") that may be pressed against the printing surface of the printhead to remove contaminants.

BRIEF DESCRIPTION OF THE DRAWINGS

The accompanying drawings illustrate various embodiments and are a part of the specification. The illustrated embodiments are merely examples and do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

Some contaminants, such as latex inks that have dried or crusted on the printing surface of the printhead, may be difficult to remove via wiping alone. A web that has been impregnated with a servicing fluid can be used to increase the effectiveness of wiping the printing surface to remove such contaminants. However, force of gravity and capillarity can cause servicing fluid to migrate downward along lengths of the web, and to migrate downward between layers of a coiled web supply. Such servicing fluid migration will result in the web having inconsistent concentrations of servicing fluid in different sections of the web.

For example, in a service station configured such that a web supply is situated beneath the printhead, servicing fluid migration can cause the servicing fluid travel downward into the web supply instead of moving with upward with the web that's being used to service the printhead. If this migration results in too small of a quantity of servicing fluid being used during a wiping operation, ink on the printhead's printing surface may not be properly removed and the performance of the printing system and print quality is negatively affected.

In another example, as web is moved from a web supply and used to service a printhead, the web supply becomes smaller. The web supply may experience increasing levels of servicing fluid concentration as servicing fluid migrates downward between layers of a coiled web supply, to a level that the entire web becomes saturated with servicing fluid. When a portion of the web with too much servicing fluid is used to wipe a printhead, air bubbles may be introduced into the nozzles. Such air bubbles can cause the nozzle not to fire, and thus negatively affect the performance of the printing system and print quality.

Embodiments described below were developed in an effort to reduce migration of servicing fluids along a web that can cause non-uniform cleaning concentrations in the web and ineffective cleaning. The embodiments shown in the accompanying drawings and described below are non-limiting examples. Other embodiments are possible and nothing in the accompanying drawings or in this Detailed Description of Embodiments should be construed to limit the scope of the disclosure, which is defined in the Claims.

Figure 1:
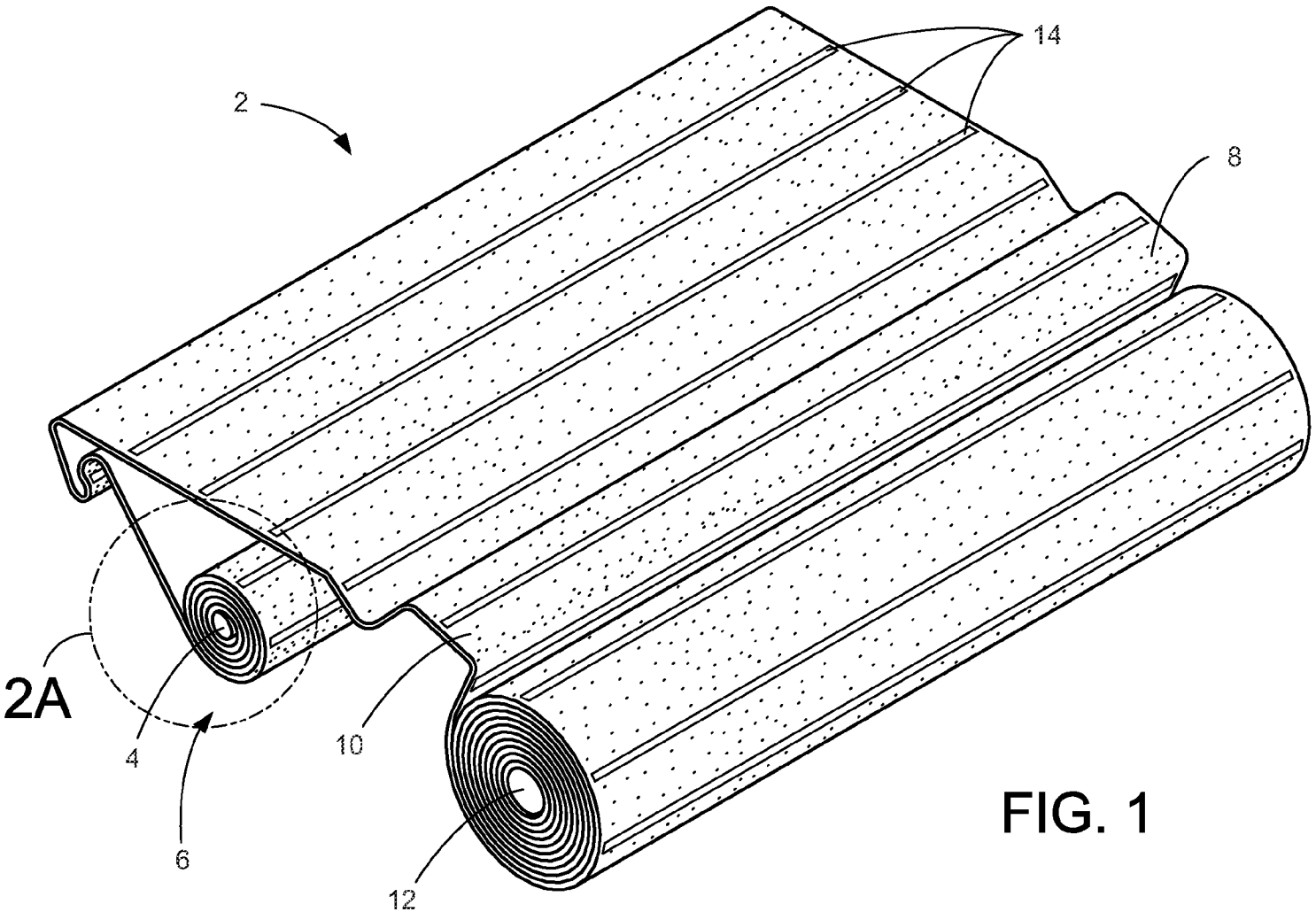
FIG. 1 is a perspective view illustrating one embodiment of a servicing article
Figure 2B:
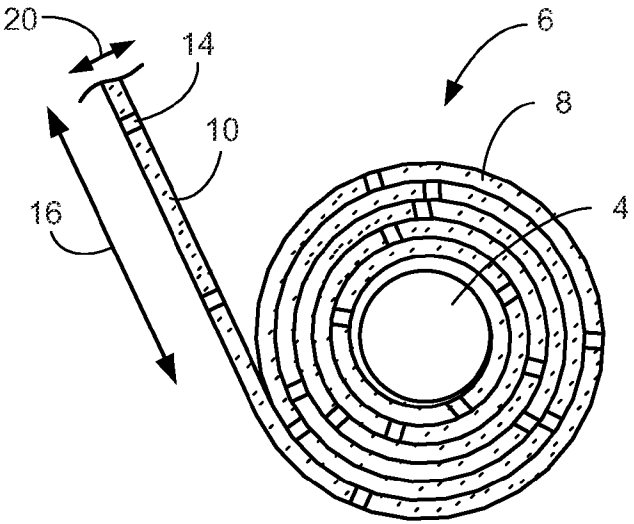
FIG. 2B is a cross-section view illustrating the servicing article of FIG. 1.
Figure 2A:
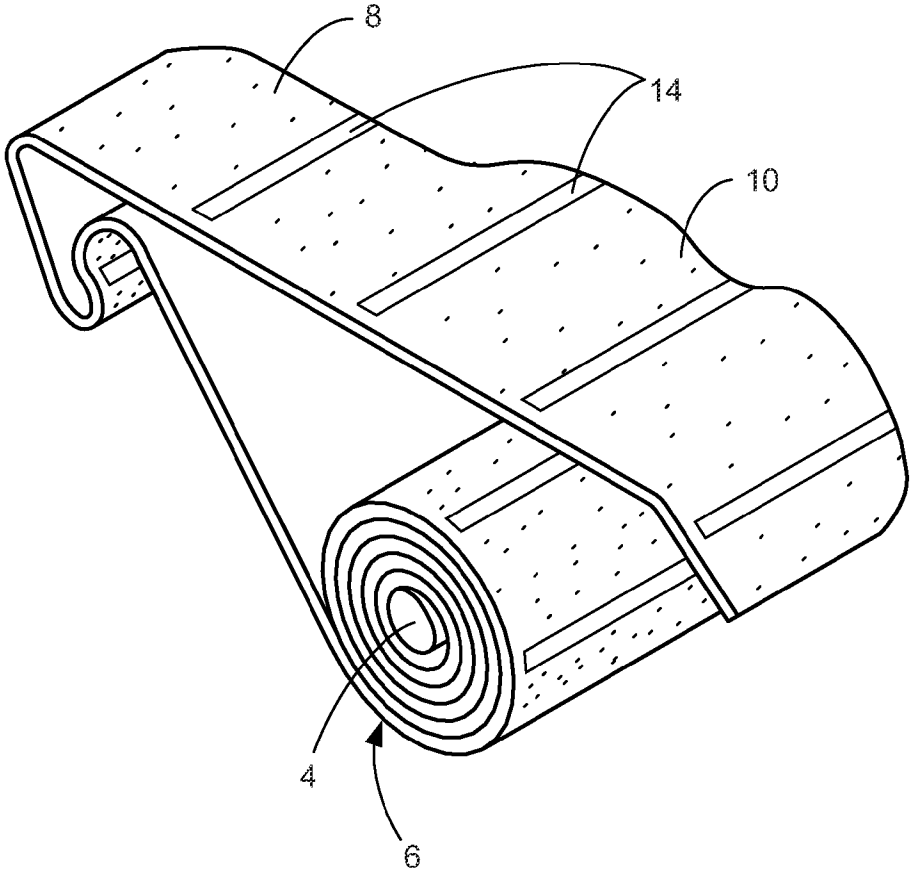
FIG. 2A is a perspective view illustrating the servicing article of FIG. 1.

FIG. 1 is a perspective view illustrating one embodiment of a servicing article. FIG. 2A is a perspective view illustrating the servicing article of FIG. 1. FIG. 2B is a cross-section view illustrating the servicing article of FIG. 1. In the exemplary embodiment a web 2 of substantially clean and unused absorbent material 10 is coiled around a web supply spool 4 so as to form a web supply 6. Web 2 from the web supply 6 may be used in performing a wiping operation upon a printhead or multiple printheads. As used in this specification and the appended claims, "printhead" includes a mechanism having a plurality of nozzles through which ink or other fluid is ejected. Examples of printheads are drop-on-demand inkjet printheads, thermo resistive printheads, piezo and resistive printheads. Some printheads may be part of a cartridge which also stores the fluid to be dispensed. Other printheads are standalone and are supplied with fluid by an off-axis ink supply.

The web 2 includes an absorbent material 10 that is configured to hold a servicing fluid 8 (speckling in the absorbent material 10 illustrates the servicing fluid). The absorbent material 10 may include a continuous length of flexible material configured to be brought in to contact with and/or pressed against nozzles of a printhead to service the printhead. In an embodiment, the absorbent material 10 may include nonwoven polymeric or non-polymeric materials that may be configured to absorb fluid. For example, web 2 may include a nonwoven polymeric material, such as EVOLON. In an embodiment, the absorbent material 10 may include a woven material. A take-up spool 12 may take up web 2 that has been used to service the printhead.

The web 2 may be impregnated with one or more servicing fluids configured to clean a printhead when the web 2 contacts and/or presses against the printhead. The web 2 may be impregnated with the servicing fluid 8 at any suitable concentrations. The web supply 6 may be may be impregnated with servicing fluid 8 in a system separate from the printing system.

The servicing fluid 8 may have any suitable properties configured to clean a printhead. The servicing fluid 8 may include a solvent that does not evaporate at ambient printer conditions. As used in this specification and the appended claims, "ambient printer conditions" includes environmental conditions inside an operating printer. The servicing fluid 8 may have a boiling point substantially greater than the exterior temperature of an operating printhead, to prevent evaporation of the servicing fluid 8 during operation of a printer. As used in this specification and the appended claims, "exterior temperature" includes a temperature at or near an outside surface. In an embodiment the servicing fluid's boiling point is greater than about 85 degrees C. In an embodiment the servicing fluid's boiling point is greater than about 100 degrees C. In an embodiment the servicing fluid's boiling point is greater than about t 200 degrees C. Additionally, the servicing fluid 8 may have a sufficient viscosity and/or surface tension such that the fluid remains in the web 2 and flows out of the web 2 when the web 2 contacts and/or is pressed against the printing surface of the printhead. For example, the servicing fluid 8 may have a viscosity of about 5.4 to 6.4 centipoise (cP) at 98 degrees C.

The servicing fluid 8 may, for example, include any suitable solvent having one or more of the properties discussed above, such as polyethylene glycol. Any suitable commercial grades of polyethylene glycol may be used, such as PEG 300, PEG 400, etc. The polyethylene glycol may be in a suitable concentration in the web 2 that allows the web 2 to clean the printhead without introducing bubbles into the printhead, which bubbles would affect operation of the nozzles and affect print quality. Specifically, the suitable concentration of polyethylene glycol in the web 2 may be about 60 g/m$^2$ to about 90 g/m$^2$. Although the servicing fluid 8 is discussed to include polyethylene glycol, the servicing fluid 8 may alternatively, or additionally, include on or more other solvents(s) and/or other types of fluids, with one or more of the properties discussed above.

In an embodiment, the servicing article includes a plurality of physical barriers 14 within the absorbent material 10, the barriers 14 extending approximately across the absorbent material's width to restrict servicing fluid migration lengthwise along the web 2. As used in this specification and the appended claims, "across" includes approximately extending from one edge of the width to the other edge of the width of the absorbent material 10. As used in this specification and the appended claims, "lengthwise" includes the long direction 16 of the web 2.

In an embodiment, the barriers 14 may be situated such that the barriers 14 are approximately parallel to each other. In an embodiment, the barriers 14 are situated such that the barriers' lengths are approximately perpendicular to the web's length. In an embodiment, barriers 14 may be extend approximately across the width of the absorbent material 10 without gaps or breaks in the length of the barriers 14.

In an embodiment the web's absorbent material 10 includes a polymer-based absorbent material 10, such as EVOLON, and the each of the plurality of barriers 14 is a weld line formed by applying a heating element to the polymer-based absorbent material. The weld lines in the absorbent material 10 are resistant to the servicing fluid 8, and therefore useful in restricting migration of servicing fluid 8 lengthwise along the web 2.

In an embodiment the barriers 14 comprise an additional material that is not the same material as the absorbent material 10. For example, the web's absorbent material 10 may comprise a polymeric material, and barriers 14 that are attached to or imbedded in the absorbent material 10 comprise lines of glue that act to resist the servicing fluid 8. In an embodiment the web's absorbent material 10 may comprise a cotton fabric or a paper-based material, and barriers 14 that are attached to or imbedded in the absorbent material 10 may comprise glue-based lines of material, painted rubber, plastic or polymeric materials.

Figure 3:
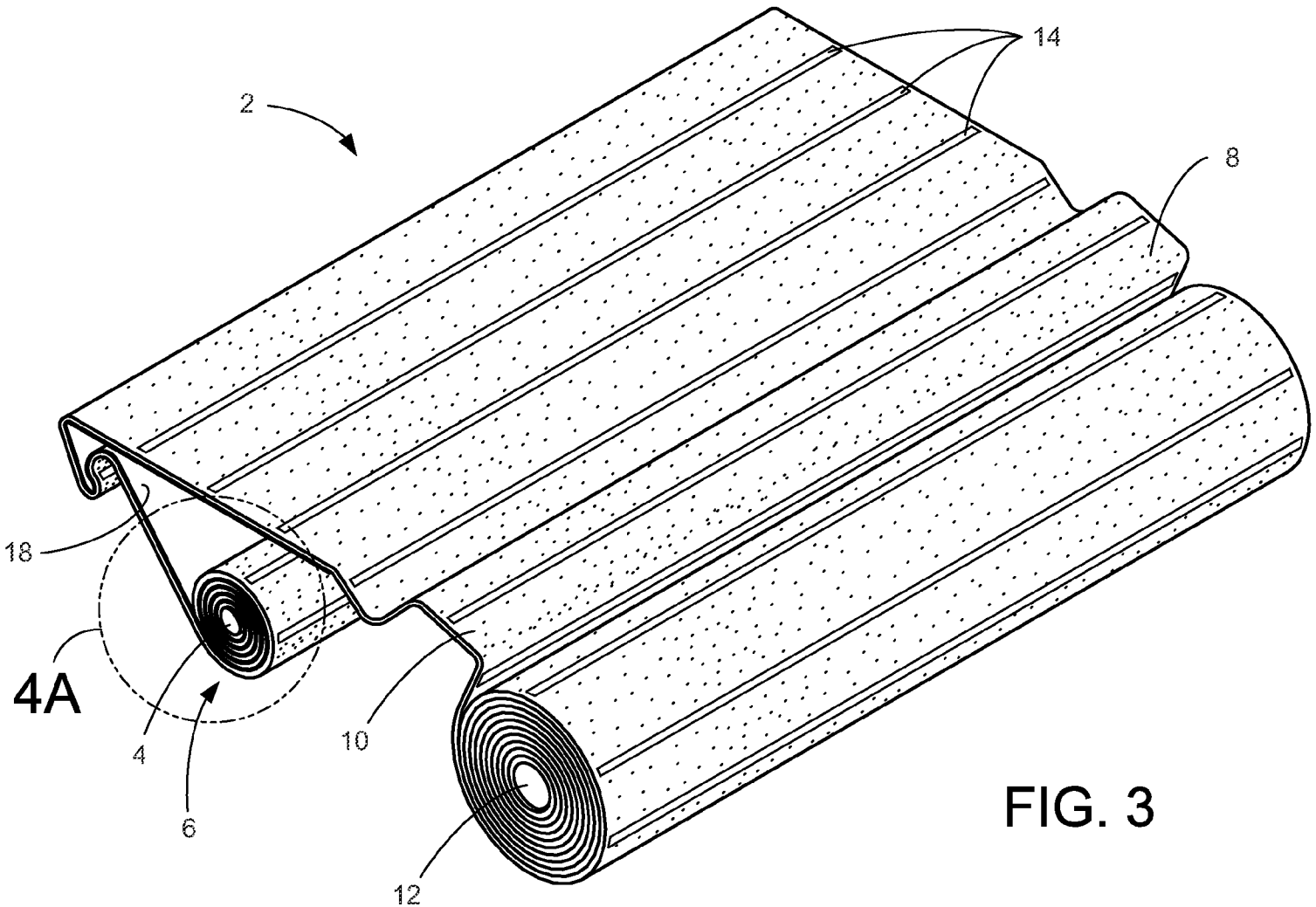
FIG. 3 is a perspective view illustrating one embodiment of a servicing article.
Figure 4B:
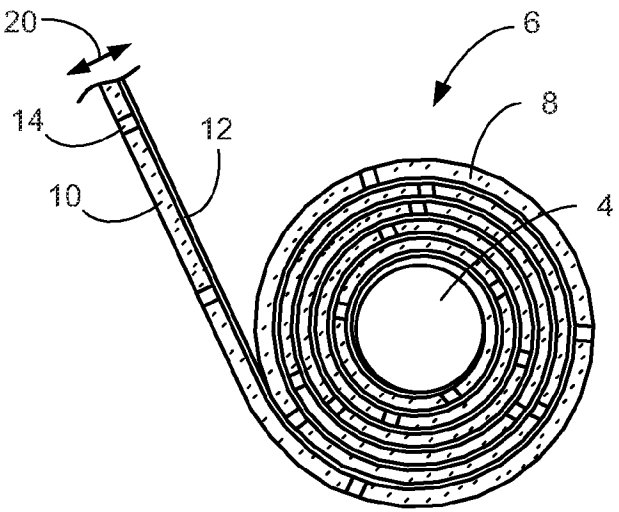
FIG. 4B is a cross-section view illustrating the servicing article of FIG. 3.
Figure 4A:
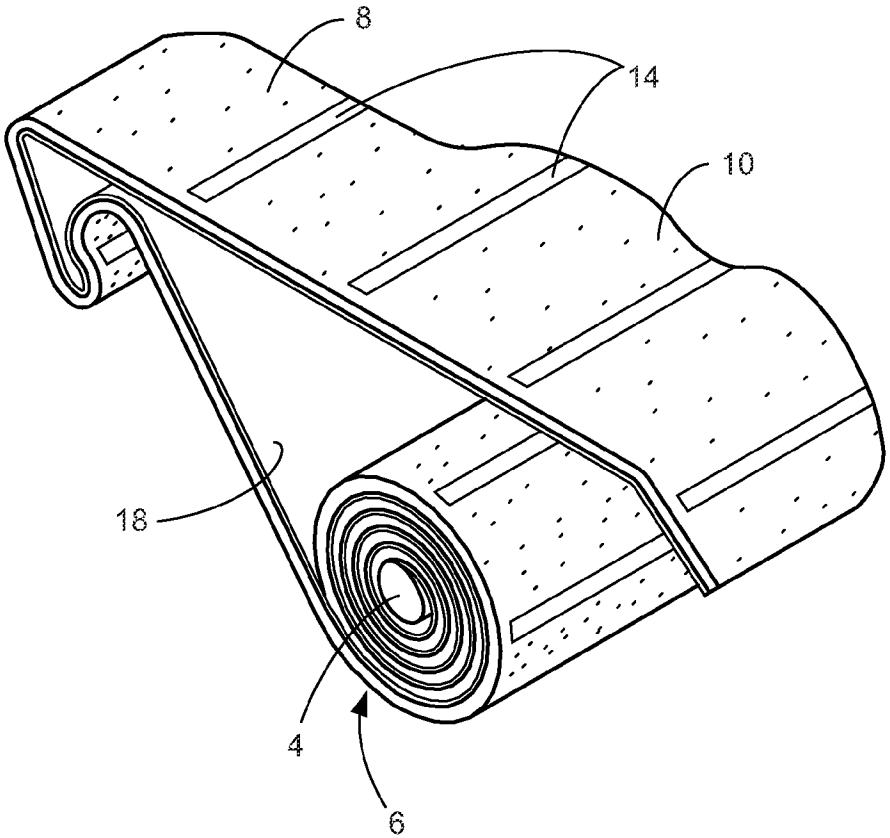
FIG. 4A is a perspective view illustrating the servicing article of FIG. 3.

FIG. 3 is a perspective view illustrating one embodiment of a servicing article. FIG. 4A is a perspective view illustrating the servicing article of FIG. 3. FIG. 4B is a cross-section view illustrating the servicing article of FIG. 3. In the exemplary embodiment a web 2 is coiled around a web supply spool 4 so as to form a web supply 6, the web 2 for use in performing a wiping operation upon a printhead 22 (FIG. 5) or multiple printheads. The web 2 includes an absorbent material 10 that is configured to hold a servicing fluid. The absorbent material 10 may include a continuous length of flexible material configured to be brought in to contact with and/or pressed against nozzles of a printhead to service the printhead. In an embodiment, the absorbent material 10 includes a non-woven polymeric material that may be configured to absorb fluid. A take-up spool 12 may be used to take up web that has been used to service the printhead. The web 2 is impregnated with one or more servicing fluids 8 configured to clean the printhead when the web 2 contacts and/or presses against the printhead (speckling in the absorbent material 10 illustrates the servicing fluid). In an embodiment, the servicing fluid 8 includes polyethylene glycol at a concentration of about 60 g/m$^2$ to about 90 g/m$^2$.

In an embodiment, the servicing article includes a plurality of physical barriers 14 within the absorbent material 10, the barriers 14 extending approximately across the absorbent material's width to restrict servicing fluid migration lengthwise along the web 2. In an embodiment, the web's absorbent material 10 includes a polymer-based material, such as EVOLON, and the each of the plurality of barriers 14 is a weld line formed by applying a heating element to the polymer-based absorbent material. The weld lines in the absorbent material 10 are resistant to the servicing fluid 8.

In an embodiment, the web 2 also includes a fluid-resistant material 18 that is resistant to a servicing fluid 8, the fluid-resistant material 18 being in contact with and approximately overlying the absorbent material 10. The fluid-resistant material 18 will resist servicing fluid migration in the direction of the web's height 20, and will resist servicing fluid migration between coils of the web 2 when the web 2 is coiled. In an embodiment the fluid-resistant material 18 has a width approximately the same as the absorbent material 10 and is fastened to the absorbent material 10. This width allows the absorbent material 10 and fluid-resistant material 18 to be coiled together to create a web supply 6. This width also allows the web 2 that includes the absorbent material 10 and the fluid-resistant material 18 to be driven by a web drive across roller supports and other structure, which supports and structure can move lengths of the web 2 from the web supply 6 to the printhead for servicing, and then on to a take-up spool 12 for collection. In an embodiment the fluid-resistant material 18 does not fasten to the absorbent material 10.

Figure 5:
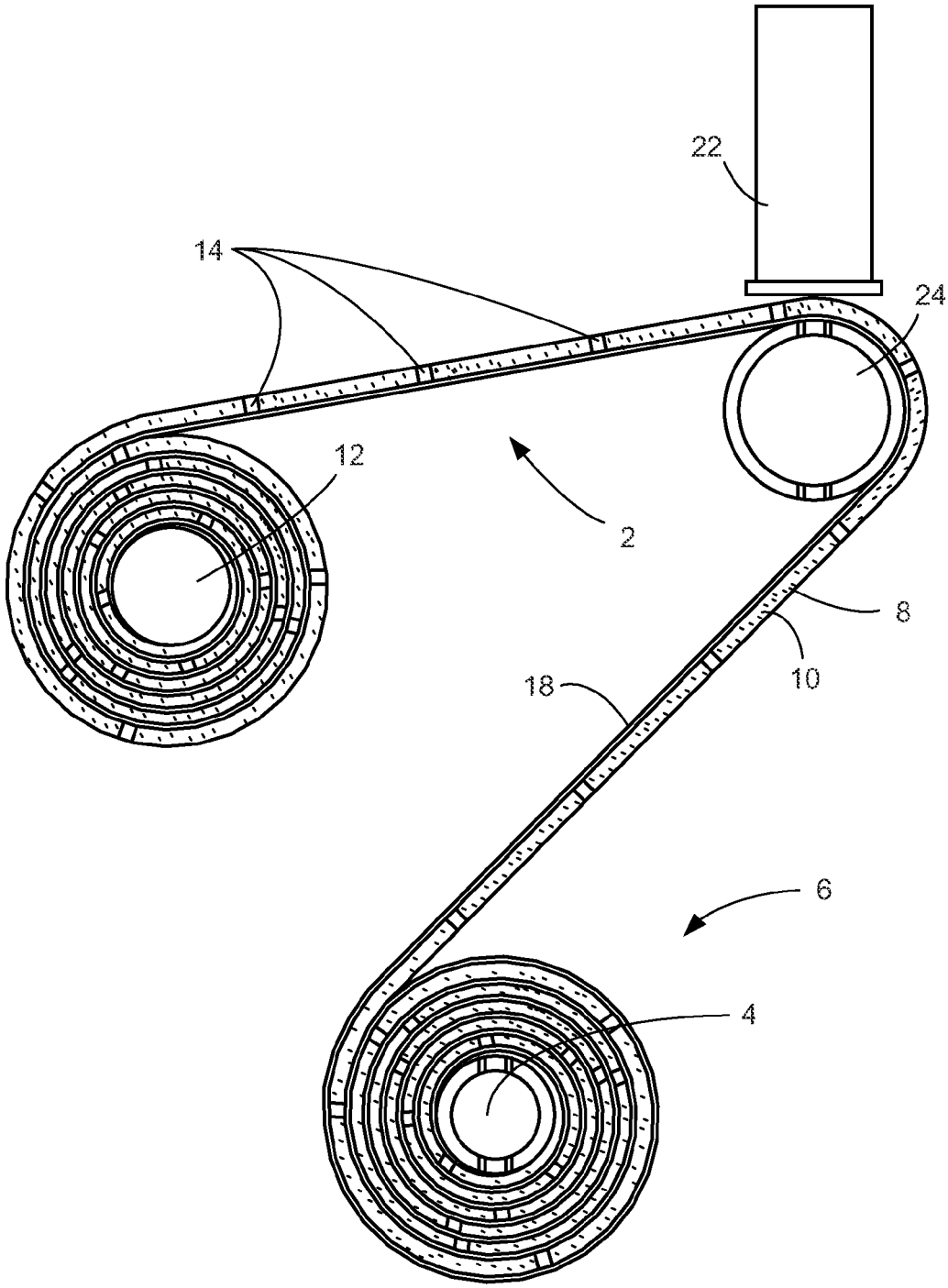
FIG. 5 is a diagram illustrating one embodiment of a consumable in an example operating environment.

FIG. 5 is a diagram illustrating one embodiment of a consumable in an example operating environment. In the exemplary embodiment, the consumable includes a web 2 of substantially clean and unused absorbent material 10 that is coiled around a web supply spool 4 so as to form a web supply 6. The web 2 from the web supply 6 may be used in performing a wiping operation upon a printhead or multiple printheads. The web 2 includes an absorbent material 10 that is configured to hold a servicing fluid 8 (speckling in the absorbent material 10 illustrates the servicing fluid). In an embodiment, the absorbent material 10 may include a woven material configured to absorb fluid.

In an example embodiment, the web 2 may be configured to contact the printhead 22 and be pressed against the printhead 22 by operation of a pressure roller 24 that urges and presses the absorbent material 10 into contact with the nozzles of the printhead 22. In an example embodiment, the web 2 may be configured to be moved alternatively between a wiping position (in which the web 2 is in contact with the printhead 22) and a non-wiping position (in which the web 2 is moved away from the printhead 22) by a substantially cylindrical pressure roller. In an example embodiment, the web 2 may be situated such that movement of the printhead 22 will result in the web 2 being in a wiping position (in contact with the printhead 22) or a non-wiping position (away from the printhead 22). In an example embodiment, the web 22 may be configured to be extended, and to have tension in the web 2 maintained during the wiping of a printhead 22, by interaction with a web drive and web supports including one or more additional rollers and/or other structure. A take-up spool 12 may be utilized to take up web 2 that has been used to service the printhead 22.

The web 2 may be impregnated with one or more servicing fluids, at suitable concentrations, configured to clean the printhead 22 when the web 2 contacts and/or presses against the printhead 22. In an embodiment, the servicing fluid 8 may include a solvent that does not evaporate at ambient printer conditions. In an embodiment the servicing fluid 8 may have a boiling point substantially greater than ambient printer temperature, in order that evaporation does not occur. As used in this specification and the appended claims, "ambient printer temperature" includes environmental temperature inside an operating printer. In an embodiment the servicing fluid's boiling point is greater than about 85 degrees C. In an embodiment the servicing fluid's boiling point is greater than about 100 degrees C. In an embodiment the servicing fluid's boiling point is greater than about 200 degrees C.

In an embodiment, the web 2 includes a fluid-resistant material 18 that is resistant to a servicing fluid 8, the fluid-resistant material 18 being in contact with and approximately overlying the absorbent material 10. The fluid-resistant material 18 will resist servicing fluid migration in the direction of the web's height 20, and will resist servicing fluid migration between coils of the web 2 when the web 2 is coiled. In an embodiment the fluid-resistant material 18 has a width approximately the same as the absorbent material 10 and is fastened to the absorbent material 10. In an embodiment the fluid-resistant material 18 does not fasten to the absorbent material 10.

In an embodiment, the consumable also includes a plurality of physical barriers 14 within the absorbent material 10, the barriers 14 extending approximately across the absorbent material's width and approximately perpendicular to the web's length to restrict servicing fluid migration lengthwise along the web 2. In an embodiment, each of the plurality of barriers 14 is a glue line formed by attaching or embedding a glue-based material to the absorbent material. In an embodiment the consumable may not include the plurality of physical barriers 14. In an embodiment, the consumable includes a web supply spool 4, which connects to the web 2 and upon which the web 2 may be coiled.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A servicing article, comprising:

a coiled web comprising a first material impregnated with a servicing fluid, the servicing fluid including a solvent having a boiling point greater than 85 degrees C.

a plurality of physical barriers within the first material, extending substantially across the first material's width, to restrict servicing fluid migration lengthwise along the web; and a second material that is resistant to the servicing fluid, the second material in contact with and overlying the first material to resist servicing fluid migration between coils of the web.

2. The article of claim 1, wherein the plurality of barriers are situated such that the barriers' lengths are substantially perpendicular to the web's length.

3. The article of claim 1, wherein the plurality of barriers comprise weld lines in the first material that are resistant to the servicing fluid.

4. The article of claim 1, wherein the plurality of barriers comprise a material other than the first material that is resistant to the servicing fluid.

5. The article of claim 1, wherein the second material has a width substantially, the same as a width of the first material.

6. The article of claim 1, wherein the second material is fastened to the first material.

7. The article of claim 1, wherein the solvent includes polyethylene glycol.

8. The article of claim 7, wherein the first material is impregnated with polyethylene glycol at a concentration of 60 g/m^2 to 90 g/m^2.

9. A servicing article, comprising:

a coiled web comprising an absorbent first material to hold a servicing fluid;

a plurality of physical barriers within the first material, situated substantially across the first material's width, to restrict servicing fluid migration lengthwise along the web;

a second material that is resistant to a servicing fluid, the second material in contact with and substantially overlying the first material to resist servicing fluid migration in a direction of the web's height; and a servicing fluid, the servicing fluid including a solvent having, a boiling point greater than 85 degrees C.

10. The article of claim 9, wherein the second material has a width substantially the same as a width of the first material.

11. The article of claim 9, wherein the second material is fastened to the first material.

12. The article of claim 9, wherein the plurality of barriers are situated such that that the barriers' lengths are substantially perpendicular to the web's length.

13. The article of claim 9, wherein the plurality of barriers comprise weld lines in the first material that are resistant to the servicing fluid.

14. The article of claim 9, wherein the plurality of barriers comprise a second material that is resistant to the servicing fluid.

15. A consumable, comprising:

a coiled web, comprising:

a first material impregnated with a servicing fluid, the servicing fluid comprising a solvent, the solvent including polyethylene glycol;

a second material that is resistant to the servicing fluid, the second material in contact with and substantially overlying the first material to resist servicing fluid migration between coils of the web; and a plurality of physical barriers within the first material, situated substantially across the first material's width and substantially perpendicular to the web's length, to restrict servicing fluid migration lengthwise along the web.

16. The consumable of claim 15, further comprising a spool, and wherein the web connects to and coils upon the spool.

* * * * *

UNITED STATES PATENT AND TRADEMARK OFFICE

CERTIFICATE OF CORRECTION

PATENT NO. : 8,342,638 B2
APPLICATION NO. : 12/627720
DATED : January 1, 2013
INVENTOR(S) : Macia Sole Pons et al.

It is certified that error appears in the above-identified patent and that said Letters Patent is hereby corrected as shown below:

In column 5, line 64, in Claim 1, delete "C." and insert -- C.; --, therefor.

In column 6, line 15, in Claim 5, delete "substantially," and insert -- substantially --, therefor.

In column 6, line 22, in Claim 8, delete "60 g/m^2 to 90 g/m^2." and insert -- 60 $g/m^2$ to 90 $g/m^2$. --, therefor.

In column 6, line 24, in Claim 9, delete "web comprising" and insert -- web, comprising: --, therefor.

In column 6, line 35, in Claim 9, delete "having," and insert -- having --, therefor.

In column 6, line 41, in Claim 12, after "such" delete "that".

Signed and Sealed this
Second Day of April, 2013

Teresa Stanek Rea
*Acting Director of the United States Patent and Trademark Office*